US008251776B2

(12) United States Patent
Smith

(10) Patent No.: US 8,251,776 B2
(45) Date of Patent: Aug. 28, 2012

(54) METHOD AND APPARATUS FOR CONDITIONING A CMP PAD

(75) Inventor: Brad Smith, Gieres (FR)

(73) Assignee: Freescale Semiconductor, Inc., Austin, TX (US)

( * ) Notice: Subject to any disclaimer, the term of this patent is extended or adjusted under 35 U.S.C. 154(b) by 847 days.

(21) Appl. No.: 12/161,704

(22) PCT Filed: Jan. 23, 2006

(86) PCT No.: PCT/EP2006/002847

§ 371 (c)(1),
(2), (4) Date: Jul. 22, 2008

(87) PCT Pub. No.: WO2007/082556

PCT Pub. Date: Jul. 26, 2007

(65) Prior Publication Data

US 2011/0183584 A1 Jul. 28, 2011

(51) Int. Cl.
*B24B 49/00* (2006.01)

(52) U.S. Cl. ..... 451/10; 451/12; 451/56; 451/443

(58) Field of Classification Search ..... 451/10, 451/11, 12, 56, 63, 443
See application file for complete search history.

(56) References Cited

U.S. PATENT DOCUMENTS 4,956,944 A * 9/1990 Ando et al. ..... 451/5
5,456,627 A * 10/1995 Jackson et al. ..... 451/11
5,536,202 A 7/1996 Appel et al.
5,595,527 A 1/1997 Appel et al.
5,743,785 A * 4/1998 Lundberg et al. ..... 451/28
5,785,585 A * 7/1998 Manfredi et al. ..... 451/288
5,833,519 A 11/1998 Moore
5,893,753 A 4/1999 Hempel, Jr.
5,904,615 A 5/1999 Jeong et al.
5,916,010 A 6/1999 Varian et al.
6,022,266 A 2/2000 Bullard et al.
6,086,460 A 7/2000 Labunsky et al.
6,123,607 A 9/2000 Ravkin et al.

(Continued)

FOREIGN PATENT DOCUMENTS

EP 1075898 A2 2/2001

(Continued)

*Primary Examiner* — Eileen P. Morgan

(57) ABSTRACT

The present invention relates to a method and apparatus for conditioning a polishing pad used in chemical mechanical polishing in which a consistent pressing force can be provided between an abrasive conditioning member and the polishing pad. Specifically, a moveable weight member is provided that can be selectively moved along a length of a support arm in the conditioning apparatus. The position of the weight member relative to the position at which the abrasive conditioning member is mounted alters the resultant pressing force in view of the change in moment created. In a particular example, the positioning of the weight member can be automatically controlled using a drive mechanism controlled by a control unit, such as a computer. In a more particular example, the positioning of the weight member can be dynamically controlled if the control unit receives an external feedback upon which its control of the weight member position is based, such as a detected value of the pressing force exerted by the abrasive conditioning member. Finally, if the apparatus is appropriately arranged to permit the weight member to travel to an opposite side of the location at which the support arm is mounted from the abrasive conditioning member, then a "negative pressing force" can be generated, such that effective pressing forces less than the resting weight of the pad conditioning apparatus can be realized.

26 Claims, 2 Drawing Sheets

U.S. PATENT DOCUMENTS

| | | | | |
|---|---|---|---|---|
| 6,176,765 | B1 * | 1/2001 | Li et al. | 451/56 |
| 6,179,693 | B1 * | 1/2001 | Beardsley et al. | 451/56 |
| 6,273,797 | B1 | 8/2001 | Becker et al. | |
| 6,306,008 | B1 * | 10/2001 | Moore | 451/5 |
| 6,306,019 | B1 | 10/2001 | Finkelman | |
| 6,328,637 | B1 | 12/2001 | Labunsky et al. | |
| 6,343,974 | B1 | 2/2002 | Fran.cedilla.a et al. | |
| 6,500,054 | B1 | 12/2002 | Ma et al. | |
| 7,059,939 | B2 * | 6/2006 | Lin et al. | 451/21 |
| 7,182,680 | B2 * | 2/2007 | Butterfield et al. | 451/443 |
| 7,413,986 | B2 * | 8/2008 | Paik | 438/690 |
| 7,666,061 | B2 * | 2/2010 | Butterfield et al. | 451/5 |
| 2003/0148707 | A1 | 8/2003 | Togawa et al. | |
| 2004/0018807 | A1 | 1/2004 | Jin | |
| 2004/0224617 | A1 | 11/2004 | Towery | |

FOREIGN PATENT DOCUMENTS

| | | | |
|---|---|---|---|
| WO | 0027585 | A1 | 5/2000 |
| WO | 0115865 | A | 3/2001 |
| WO | 0149453 | A1 | 7/2001 |

* cited by examiner

METHOD AND APPARATUS FOR CONDITIONING A CMP PAD

FIELD OF THE INVENTION

The present invention relates to a method and apparatus used to condition a chemical mechanical polishing (CMP) pad used for CMP polishing of semiconductor wafers during semiconductor device fabrication.

BACKGROUND OF THE INVENTION

Chemical mechanical polishing (sometimes known in the art as chemical mechanical planarization), or CMP, is in general a well-known process used in the fabrication of semiconductor devices. CMP combines mechanical polishing (using, for example, abrasive slurries) with selective chemical reactions to increase the mechanical removal rate of material. The chemical reaction(s) particularly provide greater material removal selectivity than mechanical polishing alone.

CMP is commonly used to flatten the surface of a wafer after etch and/or deposition steps, generally to such a degree that subsequent photolithography steps have a sufficient focus margin.

In general, CMP is performed by using a polishing pad in combination with a slurry of water, abrasives, and reactive chemicals for the desired chemical reaction or reactions. The polishing pad is caused to be pressed against the wafer surface and relative motion between the wafer and the pad is imparted (that is, by moving one or both of the wafer and the pad).

The polishing pad is conventionally a porous pliable material. Polyurethane foam is particularly common for use as a polishing pad. Surface asperities of the polishing pad are critical to the polishing process because they provide the mechanical polishing action. However, as the pad is used for polishing, it tends to become smoother as the asperities are rubbed away and/or as slurry residues build up in the pores. As a result, the polishing process is degraded. It is therefore conventionally known to condition the polishing pad to roughen the surface and increase the open porosity of the foam.

FIGS. 1 and 2 are a side elevational and a perspective view, respectively, of a conventional CMP pad conditioning apparatus 10. As generally shown, an abrasive member, such as a member 12 coated with an abrasive, such as diamond, is pressed, relatively, against a surface of the polishing pad (not illustrated) with a certain force. The member 12 and the surface of the polishing pad are then moved relative to one another.

For example, abrasive member 12 is mounted on an arm 14 (by way of a mount or support 20) in a known manner. The arm 14 may be in turn pivotably mounted in a known manner such that the arm 14 can be raised or lowered so as to press a surface of member 12 against a surface of a polishing pad as desired. The arc labeled R in FIGS. 1 and 2 indicate this motion of arm 14 about an axis 17.

An alternative known system (not illustrated) does not pivot but instead applies a vertical pressing force by way of support 20, such as by extending and retracting support 20 along its axis.

As seen in FIGS. 1 and 2, arm 14 may be also laterally rotatable about an axis 16 so that the arm 14 (and the member 12 mounted thereon) can sweep out an arc of motion relative to a polishing pad surface. The lateral sweeping motion of arm 14 may be powered, such as by a conventional motor (not shown) connected to shaft 18.

As mentioned above, arm 14 is preferably mounted at shaft 18 in a manner permitting an opposite end of arm 14 to translate vertically. In particular, this vertical translation permits member 12 to be lowered into contact with a polishing pad. The connection between arm 14 and shaft 18 is any standard arrangement permitting the required motion about axis 17, for example and without limitation, a hinge pin or a bushing/shaft assembly.

Arm 14 may be raised and lowered by any conventional means, including without limitation, manual and mechanical means (the latter not being shown).

In addition, the member 12 is mounted on the arm 14 by way of a mount or support 20 so as to accommodate raising or lowering arm 14 relative to the horizontal while maintaining a surface of member 12 in contact with a surface of the polishing pad. For example, a conventional gimbal, hinge pin, ball and socket joint, etc. structure may be provided to mount member 12. In general, member 12 is mounted so as to be pivotable about axes 21 and 23, which motion permits all angles of orientation between abrasive member 12 and an opposing polishing pad surface to be accommodated.

At the outset, it will be appreciated that the simple resting weight of the arm 14, member 12, and member mount 20 will tend to cause arm 14 to rotate about axis 17 on shaft 18 (as indicated by the arrow R), which will correspond to a given pressing force against a polishing pad surface opposed to member 12. In an alternative known arrangement, the arm 14 does not pivot about axis 17. Instead the member mount 20 (with member 12 mounted thereon) is axially movable, and its resting weight corresponds to a given pressing force against a polishing pad opposed to member 12.

However, the relative pressing force between the member 12 and the polishing pad is a very important factor in controlling polishing pad conditioning, such that variations in the pressing force cause variations in polishing pad conditioning.

In particular, the pressing force of a conditioning assembly passively resting on a polishing pad cannot be changed to provide different conditioning results or to conform to conditioning requirements for different polishing pad materials.

Some conventional arrangements envision fixedly mounting a weight on the arm in order to provide a different pressing force than that corresponding to the passive weight of the assembly.

Also, some conventional pad conditioning arrangements use sensors, such as load cells, as part of a calibration process to determine a given pressing force. However, this still does not address the problem of adjusting the pressing force during operation. Also, the magnitude of the pressing force still cannot be altered.

SUMMARY OF THE INVENTION

In view of the foregoing, a method and apparatus for conditioning a CMP polishing pad are provided as defined in the claims appended hereto.

BRIEF DESCRIPTION OF THE DRAWINGS

The present invention will be even more readily understandable in making reference to the drawings appended hereto, in which.

DETAILED DESCRIPTION OF THE PREFERRED EMBODIMENTS

Figure 1:
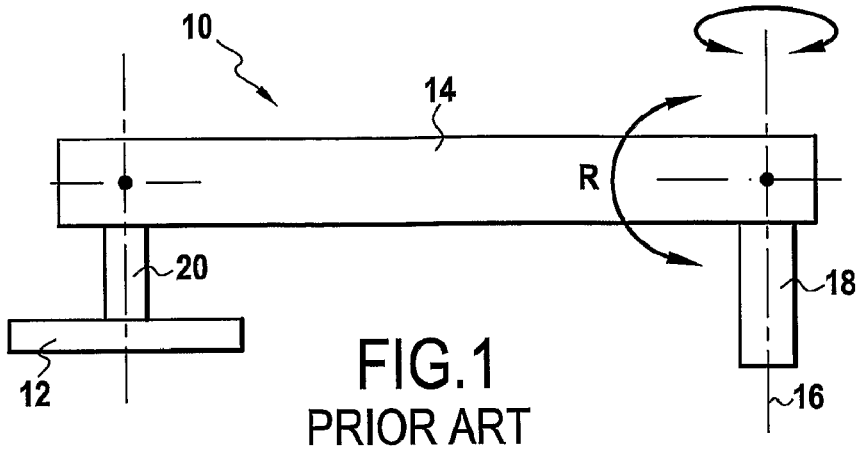
FIG.1 PRIOR ART
FIGS. 1 and 2 are side elevational and perspective views, respectively, of a conventional pad conditioning apparatus.
Figure 2:
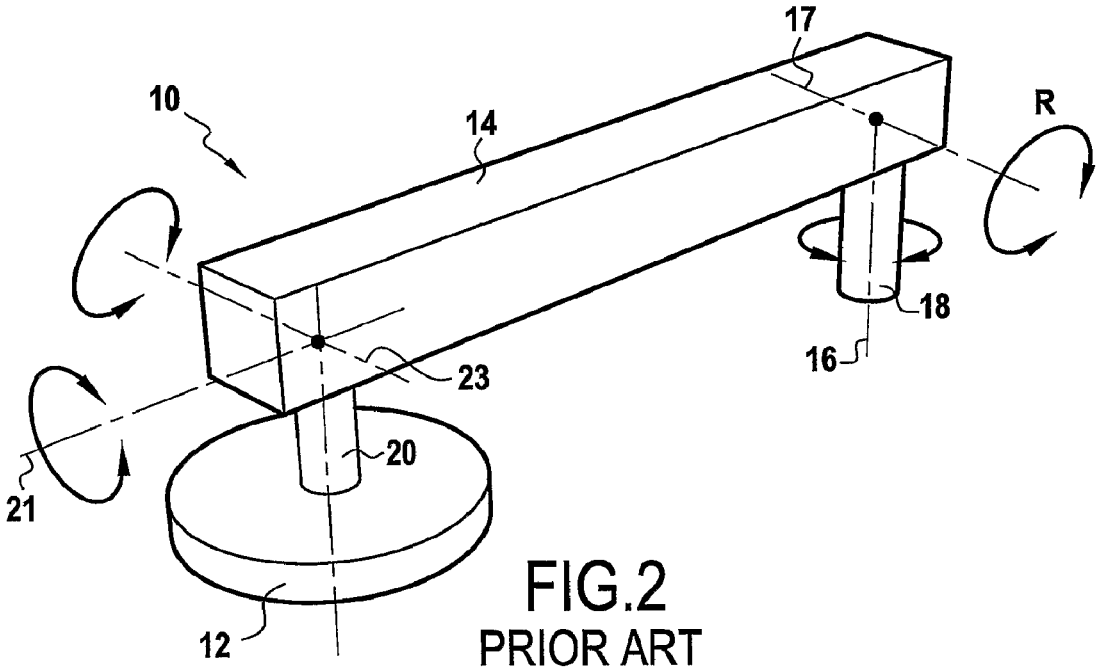
FIG.2 PRIOR ART
Figure 3:
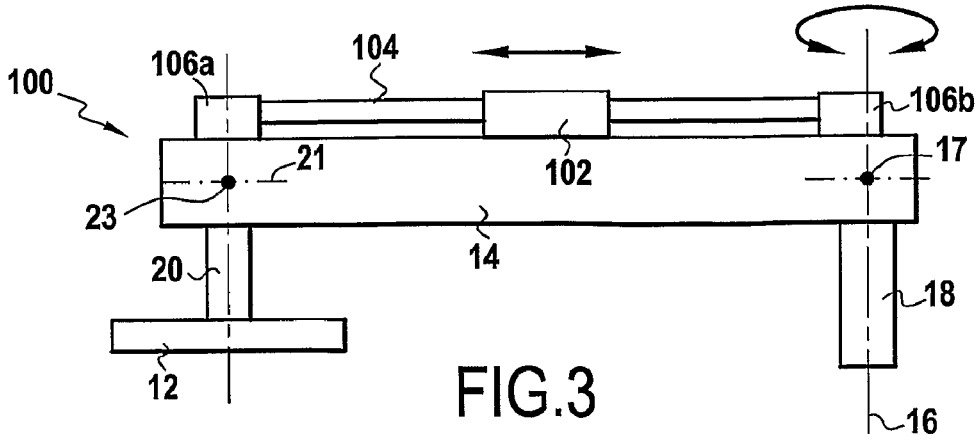
FIG. 3 is a side elevational view of a pad conditioning apparatus according to an embodiment of the present invention, given by way of example.

FIG. 3 is a side elevational view of an example of a pad conditioning apparatus 100 according to the present invention. Certain features are common with the conventional arrangement seen in FIGS. 1 and 2 and are therefore identically numbered.

Apparatus 100 particularly includes a moveable weight member 102 arranged to be moveable and selectably positionable along a length of the arm 14. In general, the pressing force applied by member 12 against a polishing pad (not shown) will increase as the position of weight member 102 approaches the position where abrasive member 12 is mounted on arm 14 and will decrease as weight member 102 moves away from that position.

Any mechanically suitable method may be used to mount the weight member 102 on arm 14 so as to be moveable therealong. For example, FIG. 3 illustrates weight member 102 mounted to as to slide on a rod or bar 104 supported by and extending between a pair of mounts 106*a*, 106*b* which are in turn each fixed on arm 14. Another arrangement (not illustrated) could comprise mounting the weight member so as to be slidably engaged in a slot formed in the arm 14. Weight member 102 is optionally in sliding contact with a surface of the arm 14.

As before, the arm 14 is mounted by any conventional means (such as a hinge pin) with respect to shaft 18 so as to be pivotable about a horizontal axis 17 generally perpendicular to the axis of rotation 16, so as to permit the opposite end to move vertically towards and away from a surface of a polishing pad. At the other end of arm 14, mount 20 for supporting abrasive member 12 is preferably freely pivotable with respect to the arm 14 and/or abrasive member 12 (by way of, for example, a ball and socket joint) so that a surface of abrasive member 12 can be maintained flush against a surface of a polishing pad. In particular, mount 20 is free to pivot at least about orthogonal axes 21, 23 so as to be able to place a surface of abrasive member 12 in any needed orientation so as to remain flush against a surface of the polishing pad.

Figure 4:
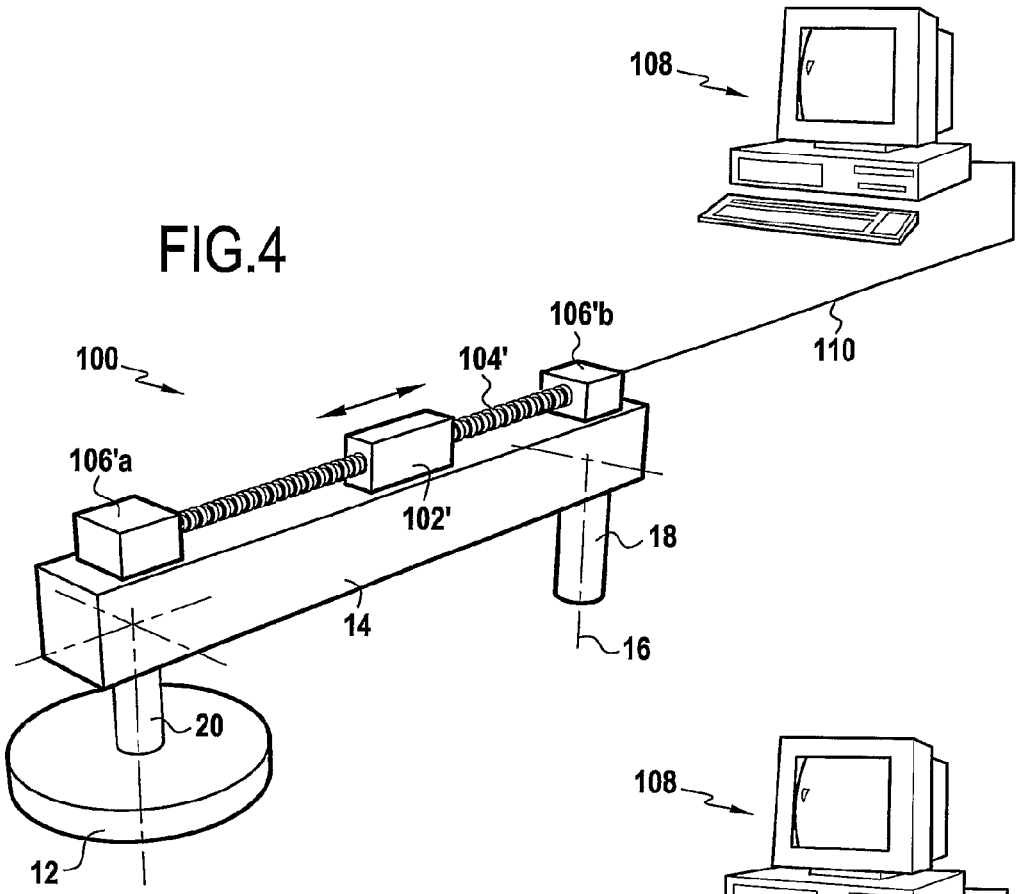
FIG. 4 is a perspective view of a pad conditioning apparatus according to an embodiment of the present invention.

FIG. 4 illustrates a particular example of the present invention in which weight member 102' is threadedly mounted on a rotatable drive screw 104'. Drive screw 104' is rotatably mounted on supports 106*a*' and 106*b*'. The drive screw 104' is driven to rotate as desired by a conventional controllable drive motor (not shown) housed in, for example, support 106*b*'.

The selective rotation of drive screw 104' causes weight member 102' to be displaced along the arm 14 in accordance with the direction in which drive screw 104' is made to rotate. With a known thread pitch, the linear displacement of weight member 102' can be correlated to a number of turns of the drive screw 104'. This can in turn be correlated to the position of the weight member 102' along the arm 14, so as to arrive at a known value of the resultant pressing force between the abrasive member 12 and the polishing pad being conditioned. This interrelationship of process parameters may sometimes be referred to as a "recipe" for conditioning a given polishing pad. The recipe may for example take into account one or both of the abrasive material of the member 12 and the material constituting the polishing pad being conditioned.

The rotation of drive screw 104' may be automatically controlled by an external control unit 108, such as a computer or the like, that provides the drive screw motor with control signals by a technically appropriate connection (physical or not) 110.

The control unit 108 may receive external inputs that affect its control of the drive screw 104'. In a particular example, the control unit may receive an input signal corresponding to a presently detected pressing force between the abrasive member 12 and the polishing pad. The pressing force could be detected, for example, by load cells, as described above with respect to conventional practice. Therefore, if a variation from a desired pressing force is detected, the control unit 108 can dynamically adjust the position of weight member 104' in order to regain the desired pressing force.

Other known methods could be used to displace the weight member along the arm, such as push-pull extensible rods and the like connected to the weight member.

Figure 5:
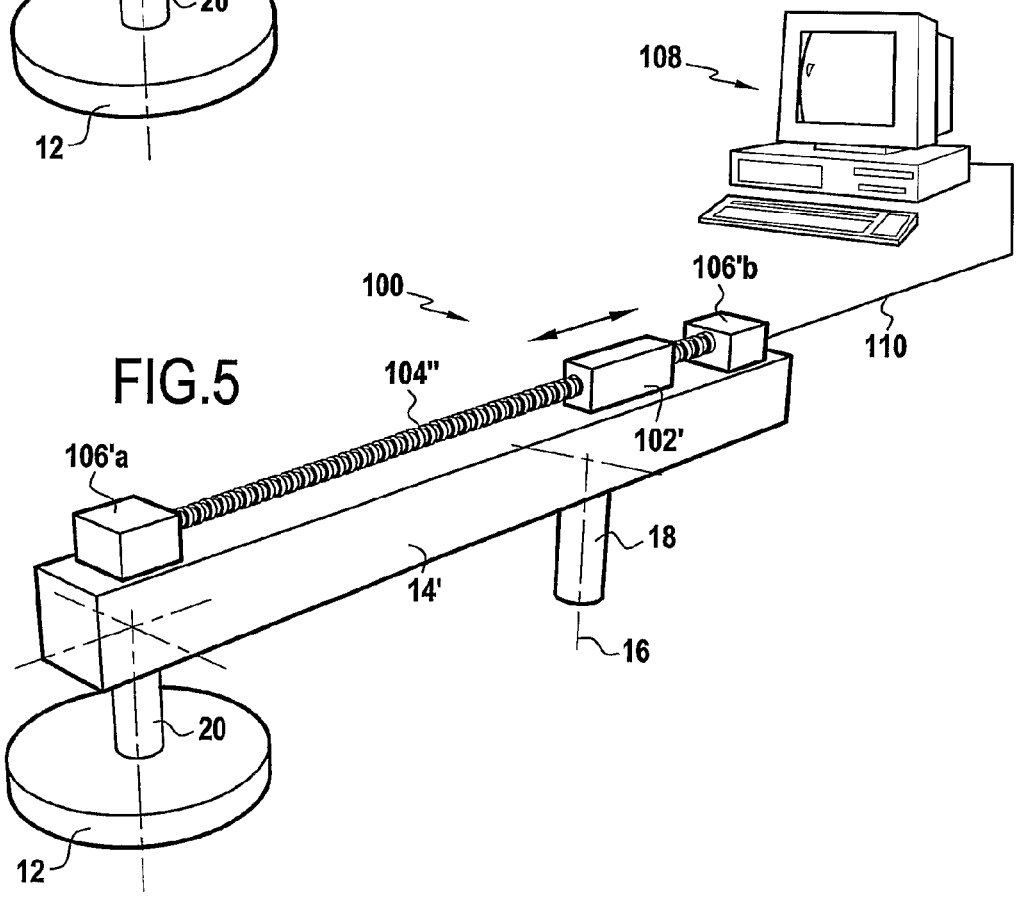
FIG. 5 is a perspective view of a variant of a pad conditioning apparatus according to another embodiment of the present invention.

FIG. 5 illustrates a further variant of the present invention. In general, the apparatus illustrated in FIG. 5 is similar to that illustrated in FIG. 4, except for the fact that weight member 102' is permitted to move along arm 14' to either side of the location at which arm 14' is mounted at 18. This may correspond either to extending one end of arm 14' in comparison with arm 14 of FIG. 4, or to moving the location at which arm 14' is supported inwards (i.e., away from the end of arm 14').

In general, if weight member 102' is moved to the opposite side of mount 18 from the location at which abrasive member 12 is mounted, a moment is created in the opposite sense of that created by the passive weight of the abrasive member/arm combination. More particularly, this offers the possibility of expanding the range of pressing forces that can be generated by the apparatus so as to include pressing forces less than that created by the resting weight of the pad conditioning apparatus. That is, positioning the weight member 102' on the opposite side of shaft 18 in effect counteracts the weight of the apparatus extending on the other side of shaft 18.

In all other respects, the implementation of the present invention illustrated in FIG. 5 is identical to that shown in FIG. 4.

Although the present invention has been described above with reference to certain particular preferred embodiments, it is to be understood that the invention is not limited by reference to the specific details of those preferred embodiments. More specifically, the person skilled in the art will readily appreciate that modifications and developments can be made in the preferred embodiments without departing from the scope of the invention as defined in the accompanying claims.

The invention claimed is:

1. An apparatus for pressing a CMP pad conditioning member against a surface at a predetermined force, comprising:

a support arm having a first surface along a length of the support arm;

an abrasive conditioning member~mounted at a first location of the support arm; and a shaft for the support arm located at a second location of the support arm spaced away from the first location, characterized in that it comprises a moveable weight constructed and arranged to be selectably positionable at a location over the first surface between the first location and the second location along the length of the support arm wherein the predetermined force is obtained by adjusting the position of the weight along the support arm.

2. An apparatus according to claim 1, wherein the moveable weight is constructed and arranged to be selectively positionable along the length of the support arm on either side of the second location.

3. An apparatus according to claim 1, wherein the mount for the support arm is constructed and arranged such that the support arm is moveable relative to the mount.

4. An apparatus according to claim 1, wherein the support arm is laterally rotatable about the mount.

5. An apparatus according to claim 1, wherein the first location of the support arm is vertically moveable relative to the mount such that the first location can be raised and lowered relative to the second location.

6. An apparatus according to claim 1, characterized in that wherein the conditioning member is pivotably mounted at the first location.

7. An apparatus according to claim 1, wherein the weight is slideably mounted on a rail mounted along the support arm.

8. An apparatus according to claim 1, characterized in that wherein it further comprises a drive mechanism constructed and arranged to selectively position the weight at a predetermined location along the support arm.

9. An apparatus according to claim 8, wherein the drive mechanism comprises a rotatable drive screw in threaded engagement with a portion of the weight, wherein rotation of the drive screw corresponds to linear translation of the weight.

10. An apparatus according to claim 9, wherein the drive mechanism comprises a motor constructed and arranged to drive the rotatable drive screw according to a control signal.

11. An apparatus according to claim 10, wherein the drive mechanism comprises an automatic controller connected to and controlling the motor.

12. An apparatus according to claim 1, wherein a position of the weight along the support arm is selected according to one or both of a composition of the conditioning member and a composition of the surface against which the conditioning member is to be pressed.

13. An apparatus according to claim 1, wherein the surface against which the conditioning member is to be pressed is a chemical mechanical polishing pad.

14. An apparatus according to claim 6, wherein it further comprises a gimbal assembly for pivotably mounting the conditioning member at the first location.

15. An apparatus according to claim 1, wherein the conditioning member has an abrasive surface arranged to oppose the surface against which the conditioning member is to be pressed.

16. An apparatus according to claim 1, wherein the surface against which the conditioning member is to be pressed is a cellular polyurethane material comprising a cellular structure having at least some cells thereof being open to a surface of the polyurethane material.

17. An apparatus according to claim 1, wherein it further comprises a rotation motor constructed and arranged to drive the support arm in rotation about the mount.

18. A method of conditioning a CMP polishing pad, comprising:

pressing a conditioning member mounted on a support arm at a first location along the support arm against the polishing pad with a predetermined force, the support arm being movably mounted about a second location along the support arm, wherein the first and second locations are spaced apart from one another along a length of the support arm, the support arm having a first surface along the length of the support arm; and generating relative movement between the conditioning member and the polishing pad, wherein the predetermined force is obtained by adjusting a position of a weight that is movable over the first surface along the length of the support arm between the first and second locations.

19. A method according to claim 18, wherein adjusting a position of the weight comprises moving the weight along the support arm to a position on an opposite side of the second location with respect to the first location, such that the position of the weight generates a negative pressing force component with respect to a force with which the conditioning member is pressed against the polishing pad.

20. A method according to claim 19, wherein the negative pressing force obtained by positioning the weight on the opposite side of the second location with respect to the first location permits pressing the conditioning member against the polishing pad with a predetermined force less than that corresponding to the resting weight of the combination of the conditioning member and support arm resting against the polishing pad.

21. A method according to claim 18 wherein it comprises automatically positioning the weight along the support arm by a drive mechanism.

22. A method according to claim 21, wherein the drive mechanism is automatically controlled by a controller unit.

23. A method according to claim 21, wherein the drive mechanism comprises a rotatable threaded shaft in threaded engagement with a part of the weight, wherein rotation of the shaft corresponds to linear movement of the weight.

24. A method according to claim 18, wherein adjusting a position of the weight comprises selecting a position for the weight along the support arm and relative to the second location in accordance with one or both of a composition of the material constituting the conditioning member, or a composition of the material constituting the polishing pad.

25. A method according to claim 18 wherein the conditioning member is pivotably mounted by way of one of a gimbal and a ball and socket joint so that conditioning member can maintain a useful pressing position relative to the underlying surface.

26. A method according to claim 18, further comprising detecting the force with which the conditioning member is pressed against the polishing pad, wherein adjusting the position of the weight is performed based on a variance between the detected force and a desired force, so as to obtain the desired force.

* * * * *